United States Patent [19]

Colvin

[11] 4,151,763

[45] May 1, 1979

[54] COMBINATION ADJUSTABLE OPEN-END AND BOX-END WRENCH

[76] Inventor: David S. Colvin, 31324 Burbank, Farmington Hills, Mich. 48018

[21] Appl. No.: 842,276

[22] Filed: Oct. 14, 1977

[51] Int. Cl.[2] ..... B25B 13/10; B25B 13/18

[52] U.S. Cl. ..... 81/77; 81/128

[58] Field of Search ..... 81/77, 112, 128

[56] References Cited

U.S. PATENT DOCUMENTS

| | | | |
|---|---|---|---|
| 592,199 | 10/1897 | Fletcher | 81/77 |
| 1,215,726 | 2/1917 | Shew | 81/77 X |
| 1,444,907 | 2/1923 | Fisher | 81/77 |
| 1,554,954 | 9/1925 | Fisher | 81/77 |
| 2,814,226 | 11/1957 | Lojczyc | 81/112 |
| 3,282,136 | 11/1966 | Maichen | 81/77 |

FOREIGN PATENT DOCUMENTS

| | | | |
|---|---|---|---|
| 551057 | 3/1923 | France | 81/77 |

*Primary Examiner*—James L. Jones, Jr.

*Assistant Examiner*—James G. Smith

*Attorney, Agent, or Firm*—Remy J. Van Ophem

[57] ABSTRACT

A combination wrench is provided having an adjustable box-end wrench at one end and an adjustable open-end wrench at the other end. The box-end wrench includes a longitudinally movable adjusting member which forms a movable wall of a polygonal box structure integral with one end of a housing. The open-end wrench includes a pair of jaw members interconnected with the other end of the housing by a camming mechanism which effects lateral adjusting movement of the jaw members relative one another upon longitudinal movement relative the housing. The adjusting member and jaw members are coupled together for simultaneous movement to achieve same size adjustment at both ends. A one-way ratchet lock mechanism acts between the adjusting member and the housing and includes a plurality of ratchet teeth precisely located and spaced to size the wrences for each English size and metric size bolt to be fitted.

8 Claims, 9 Drawing Figures

COMBINATION ADJUSTABLE OPEN-END AND BOX-END WRENCH

BACKGROUND OF THE INVENTION

The invention relates to an adjustable wrench and more particularly to a combined adjustable open-end wrenth and box-end wrench.

The simultaneous manufacture of products having bolts and nuts of metric size and English size has created a need by the amateur and professional mechanic for wrenches of both metric size and English size.

It is known that conventional nonadjustable wrenches including open-end, box-end and combination wrenches having one open end and one box end are commercially available in both English and metric sizes. However, the need for these wrenches in a full range of sizes for both English and metric bolts results in a costly and cumbersome proliferation of wrenches.

It is also known to provide an adjustable wrench for fitting a full range of bolts of metric and English sizes. The best known commercially available adjustable wrench is the so-called "crescent" wrench which has an open end between a fixed jaw and another jaw which is adjustable by a rotatable screw. A disadvantage of the crescent wrench is that several revolutions of the screw is required to change the wrench between the largest and smallest sizes. Another disadvantage is that the crescent wrench is difficult to maintain at a selected adjusted position because a very slight inadvertent rotation of the screw enlarges the opening sufficiently to result in rounding of the corners of the bolt head. Furthermore, the adjusting screw is oriented generally normal to the longitudinal axis of the wrench handle, thereby causing the crescent wrench to have a large width adjacent the jaws which may not conveniently fit a bolt head because of obstructions located adjacent the bolt head.

SUMMARY OF THE INVENTION

My present invention relates to improvements in adjustable wrenches which overcome the shortcomings of the commercially available and previously known wrenches.

The invention provides a combination adjustable open-end and box-end wrench. The wrench includes an elongated handle having an integral polygonal box structure at one end defining spaced apart bolt engaging surfaces disposed 60° relative one another. An adjusting member is longitudinally slidably mounted within the housing and extends therefrom to form a movable wall of the box structure disposed at a 60° angle from the bolt engaging surfaces thereof to cooperate in gripping a bolt head therebetween. A pair of jaw members are reciprocably mounted for extension and retraction from the other end of the housing and have opposed laterally spaced apart bolt engaging surfaces facing each other at a predetermined angular relationship to provide an open-end wrench for gripping the bolt head. Camming means act between the housing and the jaw members to effect relative lateral movement of the jaw members toward one another to reduce the space therebetween upon retraction into the housing and away from one another to enlarge the spacing therebetween upon extension out of the housing. A pin and slot arrangement connects the adjusting member and the jaw members to cause retraction at one end of the wrench and simultaneous extension at the other end whereby the open-end wrench and box-end wrench are simultaneously adjuted to fit the same size bolt head. A one-way ratchet mechanism acts between the adjusting member to block retraction of the adjusting member to enlarge the box-end wrench and simultaneously block extension of the jaw members from the housing to enlarge the open-end wrench. The wrench may be adjusted to a desired size by thrusting the open-end wrench over a bolt to effect retraction of the jaw members relative the housing as permitted by one-way ratchet action of the lock mechanism. The ratchet teeth of the one-way lock mechanism are precisely located and spaced relative one another to provide locking positions of the open-end and closed-end wrenches corresponding to each desired metric size and English size bolt.

One feature, object and advantage of my invention is the provision of a combination open-end and box-end wrench having an adjusting mechanism which causes simultaneous adjustment of both ends to the same size.

Another feature, object and advantage of my invention is the provision of a unique combination wrench having an open-end which is self-adjustable from a large size to fit a particular bolt size by thrusting the wrench against the bolt head and which simultaneously adjusts a box-end to the same size.

A further feature, object and advantage of my invention is the provision of a combination wrench having a pair of laterally adjustable open-end jaw members interconnected with a housing by a cam device which reacts to the spreading apart of the jaw member during torquing of the bolt by inducing longitudinal motion of the jaw members in a direction opposed by a one-way ratchet mechanism so that the jaw members are maintained at the selected size and an adjusting member for a box-end polygonal structure which also reacts to torquing of a bolt by inducing longitudinal movement in the direction opposed by the one-way ratchet.

BRIEF DESCRIPTION OF THE DRAWINGS

These and other objects, features and advantages of the invention will become apparent upon consideration of the specification and the appended drawings in which.

DESCRIPTION OF THE PREFERRED EMBODIMENT

Figures 1, 2, 3, 4, 5, 5A:
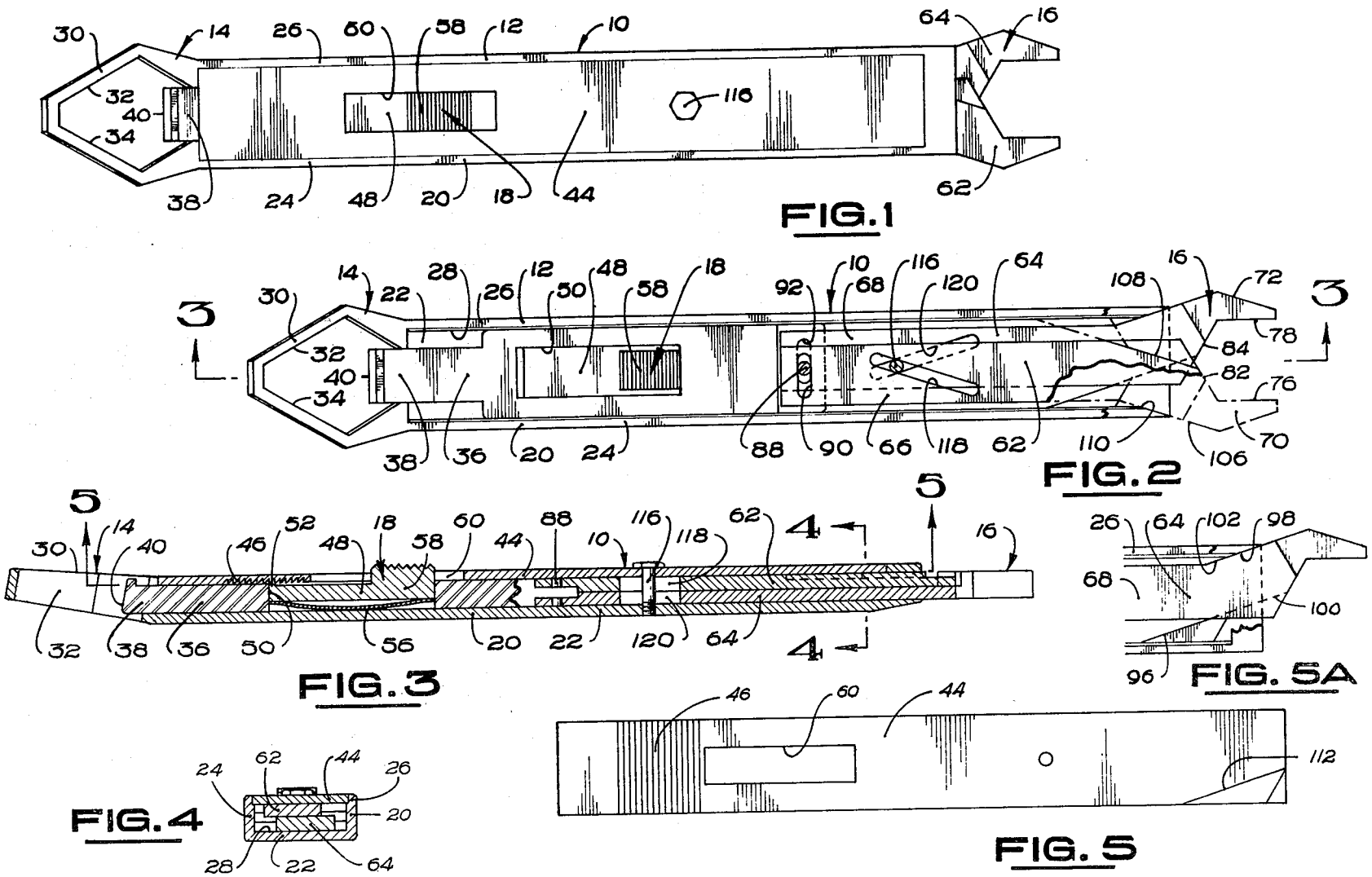
FIG. 1 is a plan view of the combination adjustable open-end wrench and box-end wrench.
FIG. 2 is a view similar to FIG. 1 but showing the cover plate of the wrench removed.
FIG. 3 is a sectional view taken in the direction of arrows 3—3 of FIG. 2.
FIG. 4 is a sectional view taken in the direction of arrows 4—4 of FIG. 3.
FIG. 5 is a sectional view taken in the direction of arrows 5—5 of FIG. 3.
FIG. 5*a* is a fragmentary view similar to FIG. 2 showing the open-end wrench parts broken away and in section.

Referring to FIG. 1, it is seen that the adjustable wrench 10 is generally comprised of an elongated handle 12 having a box-end wrench 14 at one end and an open-end wrench 16 at the other end. An adjustable locking mechanism 18 acts between the handle 12, the box-end wrench 14 and the open-end wrench 16.

Referring to FIG. 4, the handle 12 is formed by an elongated housing 20 which is U-shaped and includes a base 22 and spaced apart upstanding side walls 24 and 26 cooperating to define a longitudinally extending slot or channel 28. As best seen in FIG. 1, a polygonal box structure 30 is integral with the housing 20 at one end thereof and provides a pair of spaced apart bolt head engaging surfaces 32 and 34 which are disposed at a 60° angle relative one another to fit two of the faces of a hexagonal bolt. As seen in FIG. 3, the box-end structure 30 of housing 20 may be angled upwardly somewhat from the plane of housing base 22 so that the handle 12 will be raised above the plane of a bolt head gripped by the wrench.

An adjusting member 36 is slidably mounted in the channel 28 of housing 20 and has an end 38 extending outwardly of the housing 20 and having a bolt engaging surface 40 which is disposed at an angle of 60° relative the bolt engaging surfaces 32 and 34 to cooperate therewith in gripping the alternating faces of a hexagonal head bolt. A cover plate 44 is received in retaining recesses at the upper ends of walls 24 and 26 and overlies the adjusting member 36. The cover plate 44 has a plurality of ratchet teeth 46 which face downwardly toward the adjusting member 36. A locking lever 48 is closely captured in a recess 50 of the adjusting member 36 and has a pawl tooth 52 extending upwardly to engage one of the ratchet teeth 46. The cover plate ratchet teeth 46 and the pawl tooth 52 are angled relative one another to provide a one-way ratchet action which permits the pawl tooth 52 to ratchet over the ratchet teeth 46 during movement of the adjusting member 36 in the outward direction which moves the bolt engaging surface 40 toward the bolt engaging surfaces 32 and 34 of housing 20. The engagement between the pawl tooth 52 and one of the ratchet teeth 46 prevents longitudinal movement of the adjusting member 36 in the retracting direction which enlarges the box-end wrench 14. A leaf spring 56 acts between the housing base 22 and the locking lever 48 to urge the pawl tooth 52 into engagement of one of the ratchet teeth 46. The lock lever 48 has a push button 58 which extends through a slot 60 in the cover plate 44. The push button 58 of lock lever 48 may be depressed against the urging of the leaf spring 56 to disengage the pawl tooth 52 and permit longitudinal sliding movement of the adjusting member 36.

Referring to FIG. 1, it is seen that the open-end wrench 16 includes a pair of jaw members 62 and 64, having respective longitudinally extending shanks 66 and 68 located within the channel 28 of housing 20 and jaws 70 and 72 which extend outwardly of the housing 20. The shanks 66 and 68 of jaw members 62 and 64 overlie one another as best seen in FIGS. 3 and 4. The jaws 70 and 72 have opposing spaced-apart bolt engaging surfaces including longitudinal surfaces 76 and 78 which parallel one another and surfaces 82 and 84 which are inclined at an angle of 120° one another. Accordingly, as best seen in FIGS. 1 and 2, the bolt engaging surfaces of the jaw members 62 and 64 define the box-end wrench 16 for gripping four sides of a hex head bolt or two sides of a square head bolt.

Referring again to the FIGS. 2 and 3, it is seen that the shanks 66 and 68 of the jaw members 62 and 64 are connected to the adjusting member 36 by a pin 88 carried on the adjusting member 36 and riding in laterally extending slots 90 and 92 are provided respectively on the jaw members 62 and 64 so that longitudinal movement of the jaw members 62 and 64 and the adjusting member 36 is unitary but the jaw members 62 and 64 are permitted to move laterally relative one another and the adjusting member 36. Pin 88 may be formed integral with the adjusting member 36.

A cam mechanism acts between the housing 20 and the jaw members 62 and 64 to maintain the jaw members in parallel relationship during lateral movement relative one another to maintain a predetermined angular relationship between the bolt engaging surfaces. Referring to FIG. 5*a*, it is seen that the cam mechanism for jaw member 64 includes an angled abutment surface 96 which rises from the housing base 22 and an opposing abutment surface 98 provided on the upstanding wall 26. The jaw member 64 has angled surfaces 100 and 102 respectively engaging the housing abutment surfaces 96 and 98. Referring to FIG. 2, the jaw member 62 has similar angular surfaces 106 and 108 which are captured between an abutment surface 110 of housing upstanding wall 24 and an abutment surface 112 which projects downwards from cover 44 as best seen in FIG. 5.

The shank portions 66 and 68 of the jaw members 62 and 64 are interconnected by a camming mechanism comprised of a bolt 116, or the like, which extends between the cover plate 44 and the housing base wall 22 and through angularly disposed cam slots 118 and 120 provided respectively in the jaw member shanks 66 and 68. The angle of the cam slots 118 and 120 in shanks 66 and 68 of the jaw members is the same as the angle of the mating surfaces at the outer ends of the jaw members. Accordingly, upon longitudinal sliding movement of the adjusting member 36 and jaw members 62 and 64, the interaction between the mating angle surfaces of the housing and jaw members and the bolt and slots will effect parallel lateral movement of the jaw members relative one another to maintain the jaw members in their angular positions relative one another.

OPERATION

Depression of the button 58 of the lock lever 48 permits longitudinal retracting movement of the adjusting member 36 in the direction ordinarily blocked by engagement of the lock lever pawl tooth 52 with the ratchet teeth 46 of the cover plate 44. Retraction of the adjusting member 36 carries the bolt head engaging surface 40 of the adjusting member 36 away from the bolt engaging surfaces 32 and 34 of the box-end structure 30 of the housing 20 so that the box-end wrench 14 is enlarged while the open-end wrench is simultaneously enlarged. Subsequent to the fitting of the box-end wrench over a bolt, the bolt may be torqued by rotating handle 12 about the bolt. The resultant longitudinal force on the adjusting member is opposed by engagement of lock lever pawl 52 with the engaged tooth 46.

The longitudinal retracting movement of the adjusting member 36 to enlarge the box-end wrench simultaneously causes the jaw members 62 and 64 to be extended outwardly of the housing 20 and results in an interaction of the camming mechanism to spread the jaw members 62 and 64 and thereby enlarge the open-end wrench 16. It will be understood that the proper selection of length of the housing 20 and the adjusting member 36 and the jaw members 62 and 64 will result in the open-end and closed-end wrenches being simultaneously adjusted to fit the same size bolt head.

Assuming that it is desired to employ the open end 16 of the wrench, the user may thrust the open wrench 16 over the head of the bolt which is to be turned. An axial thrusting movement of the housing 20 toward the bolt causes the jaw members 62 and 64 to be retracted into the housing 20 as permitted by ratcheting of the pawl tooth 52 over the cover plate ratchet teeth 46. During such retracting movement of the jaw members 62 and 64, the camming mechanism moves the jaws 70 and 72 toward one another until the parallel bolt engaging surfaces 76 and 78 are brought into tight engagement with the surfaces of the bolt head.

Subsequent to the fitting of the open-end wrench 16 to the bolt, the bolt may be torqued by rotating the handle 10 about the bolt. During such torquing of the bolt, a force is imposed on the jaws 70 and 72 urging them to spread laterally apart. Such lateral spreading of the jaw members is opposed by the engagement of the jaw members 62 and 64 with the respective angled abutment faces 98 and 110 of the housing 20. A somewhat smaller longitudinal component of force urges extending movement of the members 62 and 64 outwardly of the housing but movement in that direction is prevented by engagement of the pawl tooth 52 with one of the ratchet teeth 46. Accordingly, the jaw members 62 and 64 are held at the desired lateral spacing during forced rotation of the bolt head to tighten or loosen the bolt.

Referring to FIG. 3, it will be understood that the location of the ratchet teeth 46 of the cover 44 and the spacing therebetween is determinative of the adjusted position of the open-end wrench and the closed-end wrench. Accordingly, it is desirable to provide a ratchet tooth 46 which will achieve an adjusted position for each desired size of both English and metric size bolts.

I have found the preferred angle of the cam slots 118 and 120 and the angle of the mating angled surfaces between the jaw members and the housing to be 18° 10.4′. I have also found that a 10° angle is preferred between the box-end structure 30 and the plane or housing base 22. For a wrench having these dimensions, the spacing between the ratchet teeth 46 for various bolt sizes is shown in the following chart:

| English Bolt Size | Metric Bolt Size | Spacing of Tooth 46 From Preceeding Tooth | Wrench Opening Obtained |
|---|---|---|---|
| 5/16 in. | 8 mm. | — | .320 |
| 11/32 in. | 9 mm. | .0564 in. | .357 |
| 3/8 in. | — | .0381 in. | .382 |
| 13/32 in. | 10 mm. | .0381 in. | .409 |
| 7/16 in. | 11 mm. | .0564 in. | .442 |
| — | 12 mm. | .0472 in. | .475 |
| 1/2 in. | — | .0472 in. | .506 |
| — | 13 mm. | .0472 in. | .537 |
| 9/16 in. | 14 mm. | .0472 in. | .567 |
| — | 15 mm. | .0503 in. | .601 |
| 5/8 in. | 16 mm. | .0503 in. | .634 |
| 11/16 in. | 17 mm. | .0883 in. | .692 |
| — | 18 mm. | .0472 in. | .723 |
| 3/4 in. | 19 mm. | .0564 in. | .760 |

A person skilled in the art may, if desired, vary these dimensions by use of the following formulae:

$$\text{Tangent } \theta = \frac{Y/X}{2}$$

-continued or $$X = 1.5\ Y \times \text{Secant } B$$

Where:

$\theta$=Angle of cam slots 118 and 120 and the mating angled surfaces surfaces 96–112

B=Angle or inclination of the box-end structure 30

X=Spacing between selected ratchet teeth 46

Y=Difference obtained in wrench opening upon adjustment by distance X

DESCRIPTION OF A SECOND EMBODIMENT

Figure 6:
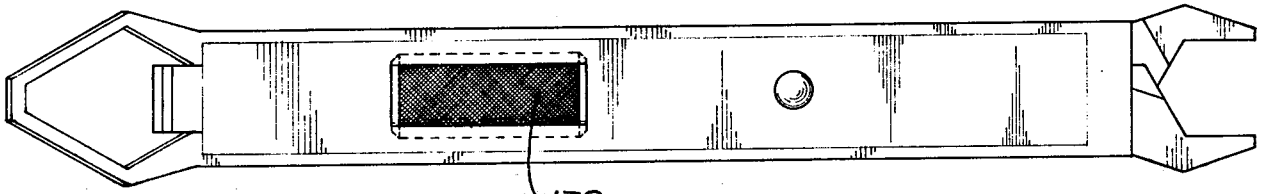
FIG. 6 is a view similar to FIG. 2 but showing a second embodiment of the invention.
Figure 7:
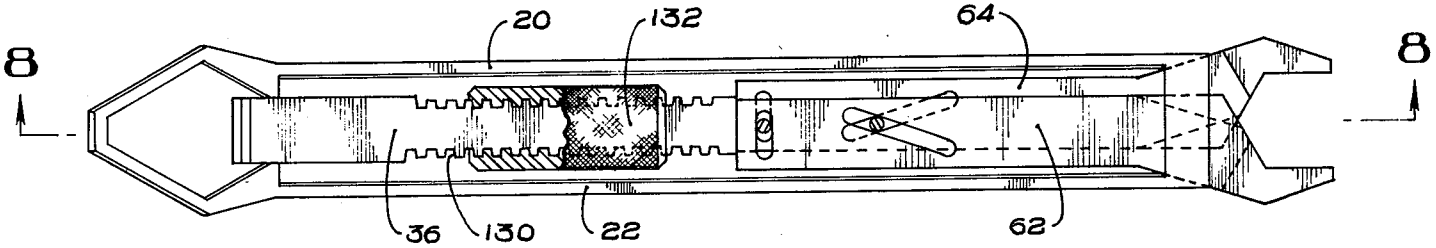
FIG. 7 is a view similar to FIG. 6 but showing the cover plate of the wrench removed.
Figure 8:
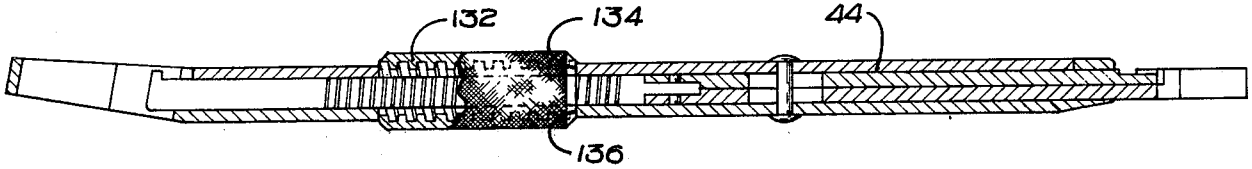
FIG. 8 is a sectional view taken in the direction of arrows 8—8 of FIG. 7.

Referring to FIGS. 6, 7 and 8, a second embodiment of the invention is shown. It is noted from the drawings the differences from the first embodiment relate only to the locking and adjusting mechanism and accordingly those elements having like structure and function are identified by like reference numerals.

As best seen in FIG. 6, the adjusting member 36 has notches 130 on its laterally spaced side surfaces which are staggered somewhat to define a thread-like arrangement. The adjusting member 36 is encircled by an adjusting nut 132 which has its outer surface knurled for ease of gripping and its inner surface threaded to engage the notches 130 of the adjusting member 36. As best seen in FIGS. 6 and 8, the adjusting nut is longitudinally captured within slots 134 and 136 provided respectively in the base wall 22 of the housing 20 and in the cover plate 44. It will be apparent that rotation of the adjusting nut 132 will cooperate with the notches 130 of the adjusting member 36 to effect longitudinal motion of the adjusting member 36 to adjust the closed-end wrench to a desired size. Simultaneously, the pin and slot connection between the adjusting member and the jaw members 62 and 64 will effect longitudinal movement of the jaw members to simultaneously achieve an adjustment of the lateral spacing between the jaw members 62 and 64.

Thus it is seen that the invention provides a new and improved combination open-end and closed-end wrench. It will be understood that a person skilled in the art may modify the wrench disclosed herein and that the scope of my invention is to be determined by reference to the appended claims.

The embodiments of the invention in which an excessive property or privilege is claimed are defined as follows:

1. A combination adjustable open-end wrench and box-end wrench comprising: an elongated housing providing a handle; a polygonal box structure provided on one end of the housing for receiving a bolt head therein; an adjusting member reciprocably mounted on the housing and having a bolt engaging surface entering the box structure and adapted to form a movable wall of the box and define therewith a box-end wrench adapted to engage various bolt sizes upon longitudinal adjusting movement of the adjusting member; a pair of jaw members reciprocably mounted on the other end of the housing and having opposing laterally spaced apart bolt engaging surfaces facing each other at a predetermined angular relationship to define an adjustable open-end wrench for gripping a bolt head therebetween; means acting between the housing and the jaw members to effect lateral movement of at least one of the jaw members relative the housing and maintain said predetermined angular relationship relative the other jaw member upon longitudinal movement of both the jaw members relative the housing; coupling means acting between the jaw members and the adjusting member to effect simultaneous longitudinal movement of the adjusting member and the jaw members and permit the lateral movement of the at least one jaw member relative the other jaw member and the adjusting member, said coupling means being further effective to induce coupled reciprocating movement of the adjusting member and the jaw members so that the open-end wrench is respectively made larger or smaller at the same time as the closed-end wrench; and adjustable locking means acting between the housing and at least one of the adjusting member and the jaw members to lock the adjusting member and jaw members at a selected position for engaging a particular bolt size.

2. The wrench of claim 1 further characterized by the adjustable locking means being a pawl and ratchet acting between the housing and the adjusting member.

3. The combination of claim 2 further characterized by the ratchet having a plurality of teeth precisely spaced to respectively adjust the wrench to fit a plurality of discrete English and metric size bolts.

4. A combination adjustable open-end wrench and box-end wrench comprising: an elongated housing providing a handle; a polygonal box structure provided on one end of the housing and having bolt engaging surfaces; an adjusting member having bolt engaging surfaces providing a movable wall of the box structure and cooperating therewith to provide an adjustable box-end wrench for gripping a bolt head; means mounting the adjusting member on the housing for extension toward and retraction away from the box structure to respectively reduce and enlarge the size of the box-end wrench; a pair of jaw members reciprocably mounted for extension from and retraction into the other end of the housing and having opposing laterally spaced apart bolt engaging surfaces facing each other at a predetermined angular relationship to provide an open-end wrench for gripping a bolt head; camming means acting between the housing and the jaw members to effect relative lateral movement of the jaw members at said predetermined angular relationship toward one another upon retraction to reduce the size of the open-end wrench by reducing the space therebetween and to effect relative lateral movement away from one another upon extension to enlarge the open-end wrench by enlarging the spacing therebetween; and means coupling the adjusting member and jaw members to cause retraction at one end of the wrench and simultaneous extension at the other end whereby the open-end wrench and box-end wrench are simultaneously adjusted to fit a same size bolt head.

5. The combination of claim 4 further characterized by a one-way spring-biased pawl and ratchet locking mechanism acting between the housing and the adjusting member normally permitting one-way longitudinal movement of the adjusting member and jaw members in the direction to reduce the size of the open-end wrench and the closed-end wrench and preventing longitudinal movement of the adjusting member and jaw members in the direction to enlarge the open-end wrench and closed-end wrench.

6. A combination adjustable open-end wrench and box-end wrench comprising: an elongated housing providing a handle; a polygonal box structure provided on one end of the housing for receiving a bolt head therein; and adjusting member mounted on the one end of the housing for longitudinal adjusting movement relative thereto and having a bolt engaging surface adapted to vary the size of the polygonal box; a pair of jaw members reciprocably mounted on the other end of the housing and having opposing laterally spaced apart bolt engaging surfaces facing each other at a predetermined angular relationship to grip a bolt head therebetween; means acting between the housing, the adjusting member and the jaw members to effect coordinated longitudinal movement of the adjusting member and jaw members relative the housing and to effect coordinated lateral movement of the jaw members relative one another at said predetermined angular relationship upon longitudinal movement of the adjusting member and jaw members relative the housing; said means acting between the housing, the adjusting member and the jaw members acting to move the bolt engaging surfaces of the jaw members toward one another upon longitudinal thrusting of the housing against the jaw members to automatically adjust the lateral spacing of the jaw members to provide an open-end wrench to fit a selected bolt size, and said means acting to simultaneously adjust the adjusting member longitudinally relative the polygonal box structure to provide a box-end wrench having the same size as the open-end wrench.

7. The wrench of claim 1 further characterized by the locking means being an adjusting nut captured in a slot of the housing against longitudinal movement and threadedly engaging the adjusting member to normally lock the adjusting member and being manually rotatable to effect adjustment of the wrench.

8. The wrench of claim 1 further characterized by said coupling means acting between the jaw members and the adjusting member being interfitting pin and slot means provided respectively on the adjusting member and the jaw members to permit lateral movement of the at least one jaw member relative other jaw member and the adjusting means and effectively couple the jaw members with the adjusting member for reciprocable longitudinal movement therewith.

* * * * *